US011806735B2

(12) United States Patent
Alluigi

(10) Patent No.: US 11,806,735 B2
(45) Date of Patent: Nov. 7, 2023

(54) SNAP-ON DISPENSING HEAD

(71) Applicant: GUALA DISPENSING S.P.A., Alessandria (IT)

(72) Inventor: Riccardo Alluigi, Alessandria (IT)

(73) Assignee: GUALA DISPENSING S.P.A., Alessandria (IT)

( * ) Notice: Subject to any disclaimer, the term of this patent is extended or adjusted under 35 U.S.C. 154(b) by 38 days.

(21) Appl. No.: 17/756,281

(22) PCT Filed: Jan. 9, 2020

(86) PCT No.: PCT/IT2020/000002
§ 371 (c)(1),
(2) Date: May 20, 2022

(87) PCT Pub. No.: WO2021/140530
PCT Pub. Date: Jul. 15, 2021

(65) Prior Publication Data
US 2022/0410194 A1 Dec. 29, 2022

(51) Int. Cl.
*B05B 11/00* (2023.01)
*B05B 11/10* (2023.01)

(52) U.S. Cl.
CPC ..... *B05B 11/1047* (2023.01); *B05B 11/1011* (2023.01)

(58) Field of Classification Search
CPC ..... B05B 11/1047; B05B 11/1011; B05B 11/001; B05B 11/1045; B05B 11/1057; B05B 11/0044
See application file for complete search history.

(56) References Cited

U.S. PATENT DOCUMENTS 5,725,132 A * 3/1998 Foster ..... B05B 11/001 222/383.1
6,138,873 A * 10/2000 Gramola ..... B65D 41/47 222/153.14
7,478,739 B2 * 1/2009 Foster ..... B05B 11/1077 215/222
2008/0257913 A1 * 10/2008 Contiero ..... B05B 11/1045 222/383.1
2016/0214130 A1 * 7/2016 Alluigi ..... B05B 11/0044
2020/0261934 A1 * 8/2020 Alluigi ..... B05B 11/001

FOREIGN PATENT DOCUMENTS

EP 0867230 A2 9/1998
EP 1982770 A2 10/2008
WO 2019092517 A1 5/2019

OTHER PUBLICATIONS

International Search Report and Written Opinion for International Patent Application No. PCT/IT2020/000002, dated Jul. 28, 2020, 10 pages.

* cited by examiner

*Primary Examiner* — Vishal Pancholi
(74) *Attorney, Agent, or Firm* — Armstrong Teasdale LLP

(57) ABSTRACT

A connection system between a dispensing head and a bottle of a trigger dispensing device includes a skirt having a seat configured as an inlet on an inner surface, and a neck having a rib protruding from an outer surface. In a relative assembled position, the rib is angularly aligned with the seat while, outside of the relative assembled position, the rib constitutes an impediment to axial insertion of the skirt on the neck.

19 Claims, 6 Drawing Sheets

SNAP-ON DISPENSING HEAD

CROSS-REFERENCE TO RELATED APPLICATION

This application is a National Stage Application of International Patent Application No. PCT/IT2020/000002, having an International Filing Date of Jan. 9, 2020, the entire contents of which are incorporated by reference herein.

FIELD OF THE INVENTION

The present invention is in the field of trigger dispensing devices; in particular, the subject-matter of the present invention is a connection system between a dispensing head and a bottle of a trigger dispensing device.

STATE OF THE ART

As is known, such dispensing devices are today enormously widespread in various fields: home hygiene, air fresheners, fabric treatment with stain removers or for ironing, gardening, and many others. Every year, millions of dispensing heads and bottles are produced.

In a filling system, the bottles are filled with the desired liquid, for example a detergent, and highly automated machines are used to fit the dispensing head to the respective bottle.

It is therefore essential that the connection system between the dispensing head and the bottle permits a rapid, effective and reliable application.

For this purpose, bayonet connection systems are particularly effective. An example of embodiment is illustrated in the documents EP-A2-0867230 and EP-A2-1982770 in the name of the Applicant.

Moreover, more and more often, also motivated by an increasingly widespread environmental awareness, the dispensing devices are reusable so as to be refilled by the user with the desired product, purchased in refill packs.

The connection system between the dispensing head and the bottle must therefore be reversible, in the sense that the user must be able to easily separate the head from the bottle, fill the bottle and reapply the head.

However, it has been found, also through surveys and by collecting consumer reports, that the average user faces considerable difficulties in correctly reattaching the dispensing head onto the bottle.

Such a problem is evident especially in dispensing devices for which, in order to be properly applied, the head and neck must be in a predefined mutual angular position, while the connection system would permit per se coupling in multiple relative positions.

An example of a connection system that allows the dispensing head to be applied to the neck of the bottle in a predefined angular position is illustrated in the International Application WO-A1-2019/092517 in the name of the Applicant.

OBJECT OF THE INVENTION

The object of the present invention is to create a connection system between a trigger dispensing head and the neck of a bottle, in particular of the bayonet type, which permits the head to be fitted to the neck only when the head and bottle are in a relative predefined and unequivocal angular position. In particular, the object of the present invention is to create a particularly reliable connection system, i.e. one that eliminates the possibility of incorrect assembly of the dispensing head to the neck of the bottle.

Such object is achieved by a connection system as described and claimed herein. Advantageous embodiments of the present invention are also described.

The features and advantages of the connection system according to the present invention will be apparent from the description given below, provided by way of non-limiting example.

DETAILED DESCRIPTION OF THE INVENTION

Figure 1B:
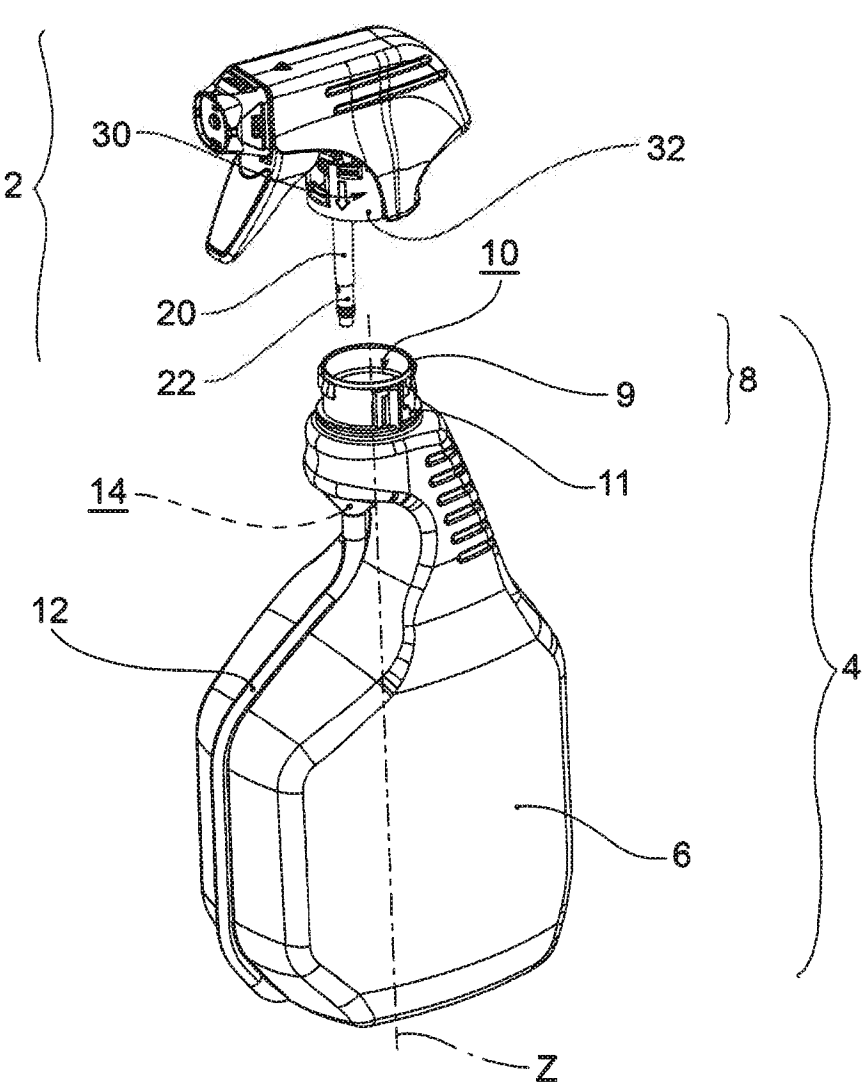
FIGS. 1*a* and 1*b* show a dispensing device according to an embodiment of the present invention, respectively in a configuration of use and in separate parts.
Figure 1A:
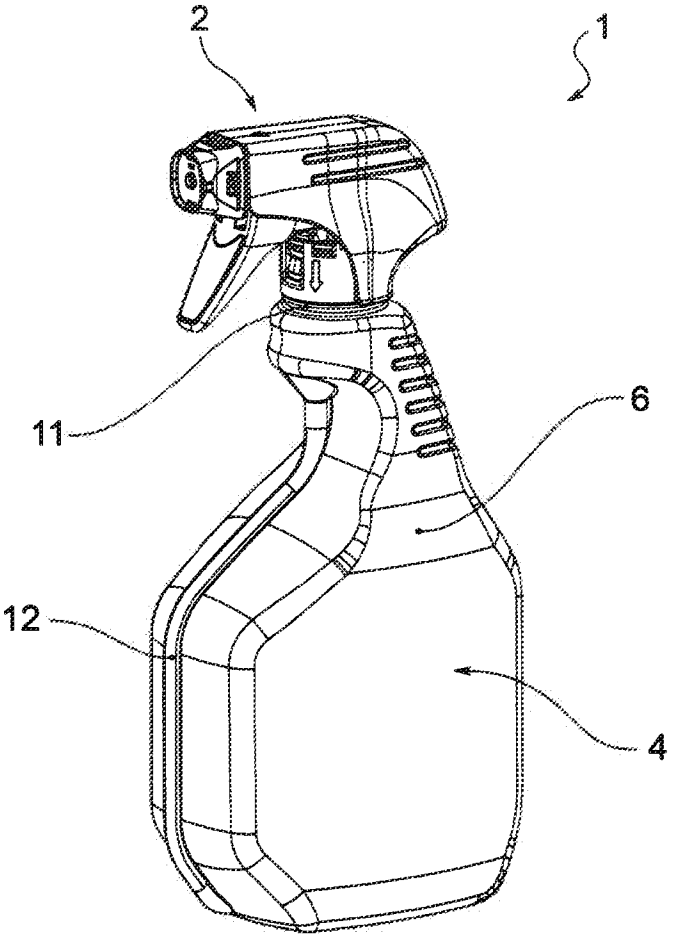
Figure 1D:
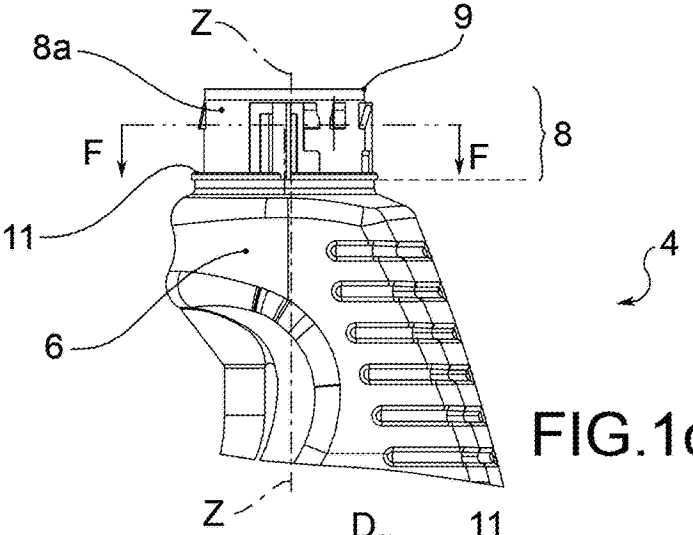
FIG. 1*d* shows a portion of a bottle of the dispensing device.
Figure 1F:
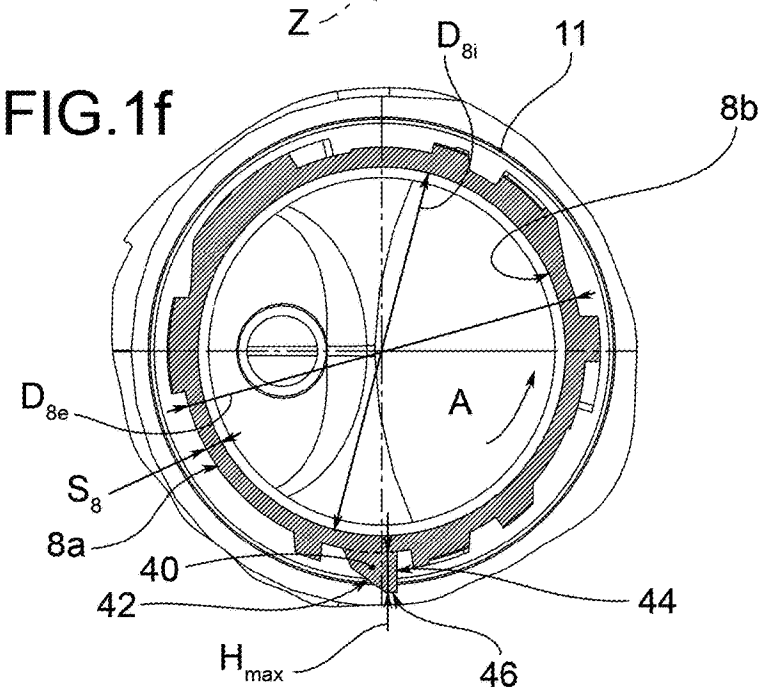
FIG. 1*f* represents a cross-sectional view of the bottle in FIG. 1*d*, according to the section line F-F in FIG. 1*d*.
Figure 1C:
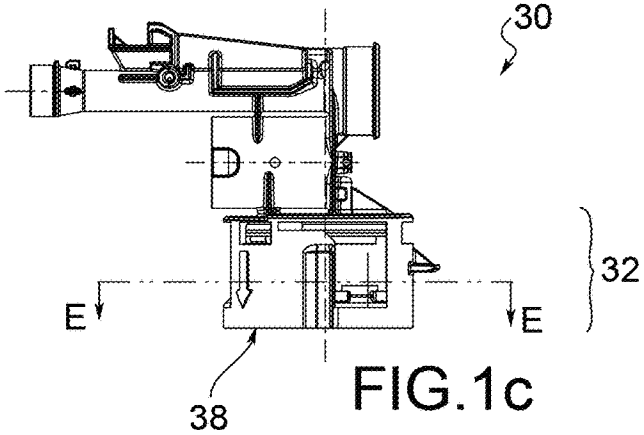
FIG. 1*c* shows a frame of a head of the dispensing device.
Figure 1E:
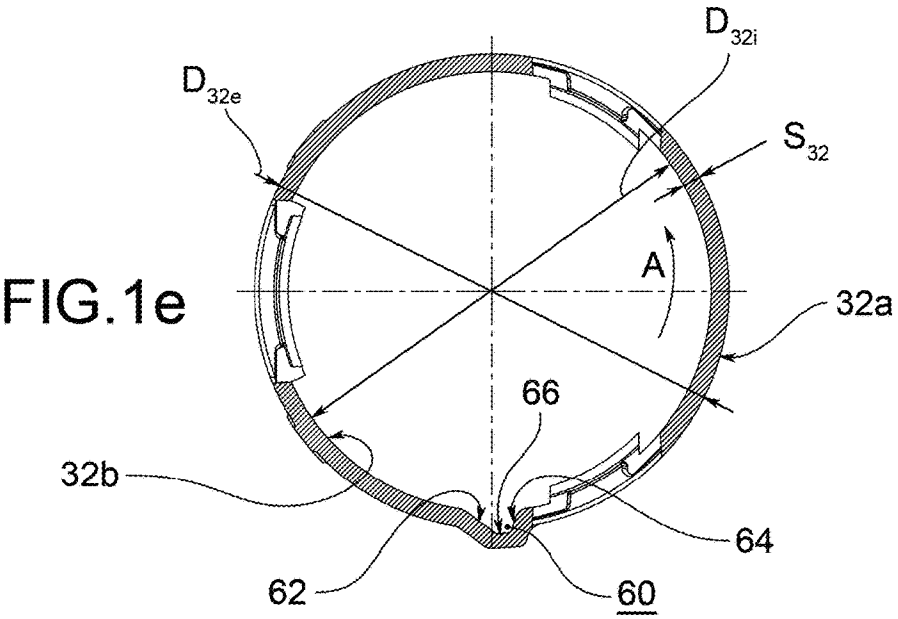
FIG. 1*e* represents a cross-sectional view of the frame in FIG. 1*c*, according to the section line E-E in FIG. 1*c*.

With reference to FIGS. 1*a* and 1*b*, a trigger dispensing device comprising a trigger dispensing head 2 and a bottle 4, to which the head 2 may be firmly applied, is collectively indicated at 1.

The bottle 4 consists of a bottle body 6, closed at the bottom, and a neck 8 having a free edge 9 which delimits a circular bottle mouth 10, having a central axis Z.

The neck 8 consists of a thin annular wall, with an outer neck surface 8*a*, having an outer neck diameter D8*e*, and an inner neck surface 8*b*, coaxial to the outer neck surface 8*a*, having an inner neck diameter D8*i*. Axially, said thin annular wall extends from said free edge 9, arranged on the top, to an annular flange 11, arranged on the bottom, protruding outwards radially.

The radial distance between the outer neck surface 8*a* and the inner neck surface 8*b* defines the thickness S8 of the neck 8 (S8=(D8*e*−D8*i*)/2); the axial distance between the free edge 9 and the annular flange 11 defines the width of the neck 8.

According to a preferred embodiment, the bottle 4 is equipped with a suction tube 12 made in a single piece with the bottle body 6, for example, arranged externally thereto, at the front.

The suction tube 12 is open at the bottom of the body of the bottle 6 in order to suck up the product to be dispensed and is open at the top by means of an engagement opening 14, on the part of the neck 8, inside the bottle 4.

Preferably, the engagement opening is arranged in the bottle body 6, i.e. below the neck 8, for example, offset with respect to the central axis Z.

The dispensing head 2 comprises a main tube 20, for example equipped with an end section 22 made of a material that is more flexible than the remaining part of the main tube 20, configured to engage with the suction tube 12 for sealed insertion into the engagement opening 14.

After the head 2 has been separated from the bottle 4, for example to fill said bottle, the head must be reapplied to the neck so that the main tube 20 enters into the engagement opening 14.

Since the engagement opening 14 is offset from the central axis Z, it is essential for the head 2 to be able to be applied to the neck 8 of the bottle 4 when said head and said neck are in a relative predefined unequivocal angular position, to which corresponds the insertion of the main tube 20 in the engagement opening 14.

The head 2 comprises a frame 30, typically made as a single piece, which supports the functional components of said head, such as a trigger, a piston, valve means, a nozzle and the like; preferably, moreover, said frame comprises portions that define additional functional parts of the head, such as a dispensing duct, a pressure chamber for the piston, and the like.

In particular, the frame 30 comprises a skirt 32 consisting of a thin annular wall that, when the head is applied to the neck, is coaxial with the main axis Z.

Said annular wall of the skirt 32 has a free edge 38, an outer skirt surface 32*a*, having an outer skirt diameter D32*e*, and an inner skirt surface 32*b*, having an inner skirt diameter D32*i*, coaxial to the inner skirt surface; the radial distance between the outer skirt surface 32*a* and the inner skirt surface 32*b* constitutes the thickness S32 of the skirt 32 (S32=(D32*e*−D32*i*)/2).

A connection system according to the present invention comprises the neck 8 of the bottle 4 and the skirt 32 of the frame 30, suitable to engage mutually, with axial overlap, by snap-engagement and according to a bayonet connection.

Description of an Embodiment of the Neck

According to the invention, the neck 8 of the bottle 4 comprises a rib 40, generally made in one piece with the neck 8, protruding from the outer surface 8*a* of the neck 8 for a maximum height Hmax with respect to the outer surface 8*a* of the neck 8.

Said maximum height Hmax is such as to create a structural interference with the skirt 32 and in particular with the inner surface 32*b* of said skirt, so as to prevent the insertion of the skirt 32 on the neck 8 if not in a predefined angular position between the skirt 32 and the neck 8, which will be discussed hereinafter.

In particular, said maximum height Hmax of the rib 8 is such that said rib 8 protrudes from the outer surface 8*a* of the neck 8 by an amount greater than half of the difference between the inner diameter D32*i* of the skirt 32 and the outer diameter D8*e* of the neck 8, so as to have a condition of interference with the inner surface 32*b* of the skirt 32 even if the skirt 32 is fitted on the neck 8 in a manner offset from the main axis Z of said neck 8.

In other words, the maximum height Hmax of the rib 8 is such that:

$$H\max > \tfrac{1}{2}(D8e - D32i)$$

The rib 40 preferably extends axially from the free edge 9 teethe annular flange 11 of the neck 8. According to further embodiments, the rib 40 extends axially only for a section between the free edge 9 and the annular flange 11.

At the free edge 9 or facing the free edge 9, the rib 40 has an upper face 40' that does not guide the insertion of the skirt of the frame; for example, preferably, the upper face 40' lies on an imaginary plane perpendicular to the main axis Z.

In addition, defining a direction of rotation, e.g. counterclockwise A, the rib 40 has a first side 42 and a second side 44, joined together by a limit surface 46 which preferably corresponds to the maximum height Hmax of the rib 40.

The first side 42 is inclined with respect to a circumferential direction, and in particular forms a ramp outwards according to the counterclockwise direction of rotation A.

Preferably, the second side 44 is flat and has a radial arrangement. Preferably, moreover, the limit surface 46 is flat.

Figure 6:
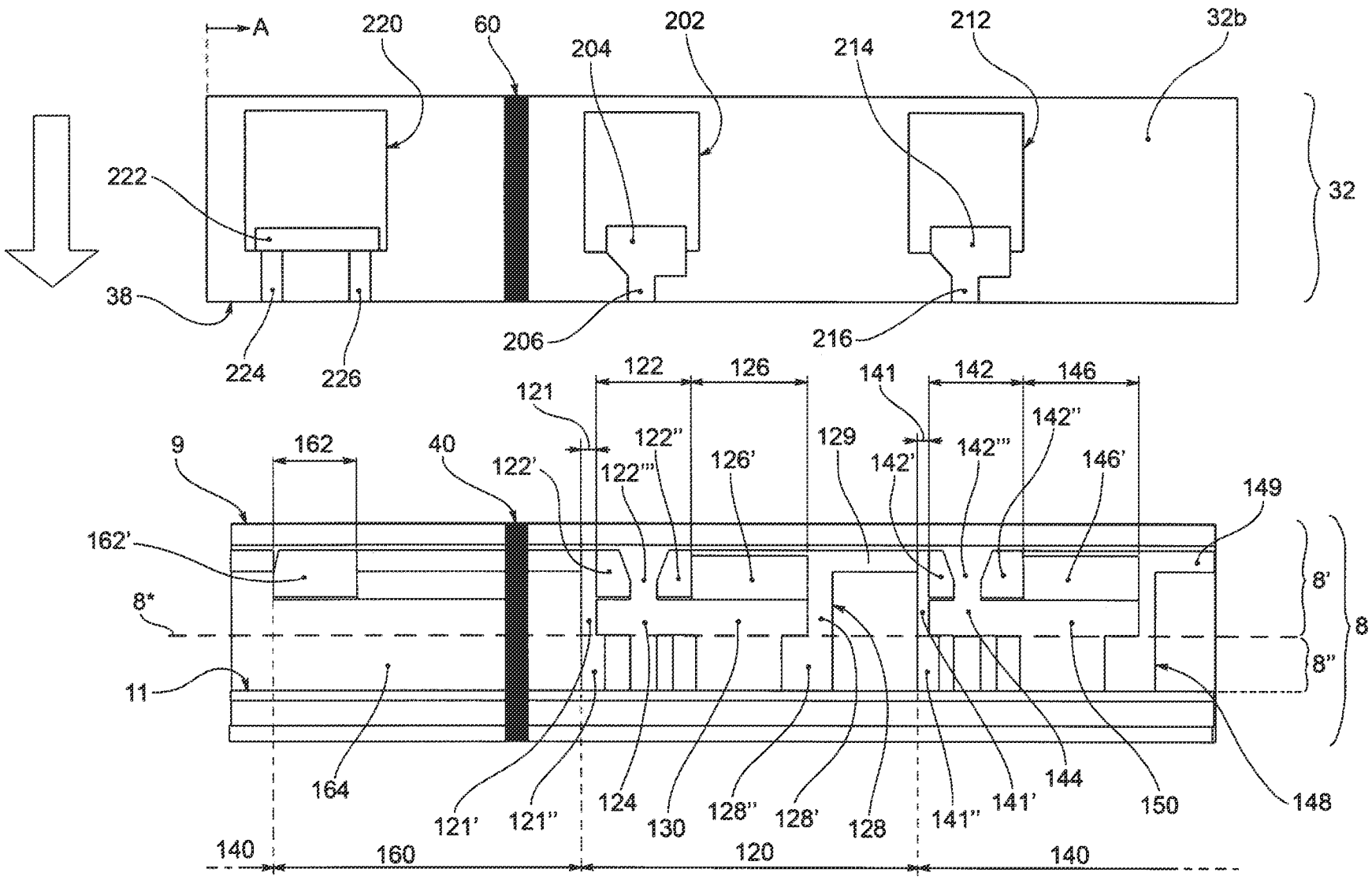
FIG. 6 schematically represents a flat development of the inner surface of a skirt of the frame and the outer surface of a neck of the bottle in a relative assembled position.
Figure 7:
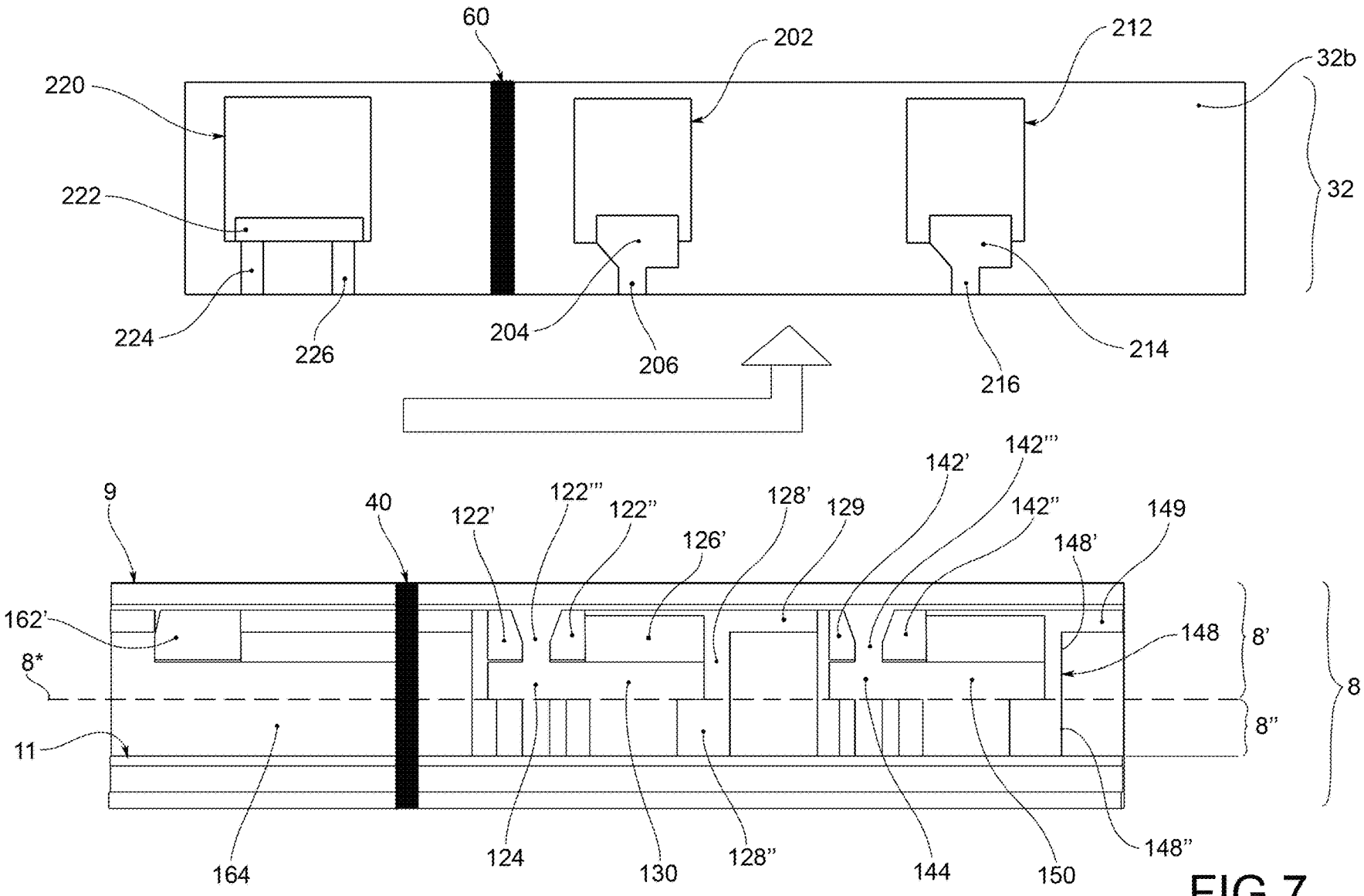
FIG. 7 represents schematically a flat development of the inner surface of the skirt of the frame and the outer surface of the neck of the bottle in a relative disassembled position.

With reference to FIG. 6, an imaginary plane orthogonal to the main axis Z defines an imaginary line 8* which on the outer surface 8*a* of the neck 8 separates an upper band 8', which extends from the free edge 9 to said imaginary line 8*, and a lower band 8", which extends from said imaginary line 8* to the annular flange 11.

Adjacent to the rib 40, in the direction of travel A corresponding to the counterclockwise direction of rotation A, the outer surface 8*a* of the neck 8 has a first coupling region 120, comprising a circumferential section of said outer surface 8*a*.

The first coupling region 120 comprises a first coupling shoulder 121 having axial extension and comprising a first section 121' in the upper band 8' and a second section 121" in the lower band 8".

Proceeding in the direction of travel A, the first coupling region 120 has a first coupling guide 122, adjacent, in particular joined, to the first coupling shoulder 121; said first coupling guide 122 consists of two sloping walls 122', 122", of increasing thickness from the free edge 9 towards the annular flange 11, circumferentially separated by a first coupling entry passage 122'" shaped like a funnel.

Below the first coupling guide 122, preferably entirely contained in the upper band 8', a surface without projections is found that defines a first circumferential coupling pocket 124, into which flows the first coupling entry passage 122'".

Proceeding in the direction of travel A, the first coupling region 120 provides for a first coupling slide 126, having extension in the upper band 8', adjacent, in particular joined, to the first coupling guide 122.

The first coupling slide 126 has a decreasing thickness from the free edge 9 towards the annular flange 11, and consists of a slide part 126'.

Between the first coupling slide 126 and the annular flange 11, an area without projections is formed, which constitutes a first coupling corridor 130 that extends circumferentially, in continuity with the first coupling pocket 124.

Proceeding in the direction of travel A, the first coupling region 120 provides for a first coupling stop 128, with a section 128' extending in the upper band 8', adjacent, in particular joined, to the first coupling slide 126, and a section 128" in the lower band 8", for example recessed with respect to the section 128'.

Preferably, finally, proceeding in the direction of travel A, the first coupling region 120 comprises a first coupling shelf 129, near the free edge 9, having mainly circumferential extension, adjacent, in particular joined, to the first coupling stop 128.

Adjacent to the first coupling region 120, in said direction of travel A, the outer surface 8*a* of the neck 8 has a second coupling region 140 with structural and functional characteristics similar to those of the first coupling region 120.

In particular, said second coupling region 140 comprises:

a second coupling shoulder 141 with a first section 141' and a second section 141";

a first coupling guide 142, with sloping walls 142', 142" and a second coupling entry passage 142'";

a second coupling pocket 144;

a second coupling slide 146 with a slide part 146';

a second coupling corridor 150;

a second coupling stop 148 with a section 148' in the upper band 8' and a section 148" in the lower band 8";

preferably, a second coupling shelf 149.

Finally, the outer surface 8*a* of the neck 8 has a reference region 160, for example adjacent to the second coupling region 140.

Figure 5:
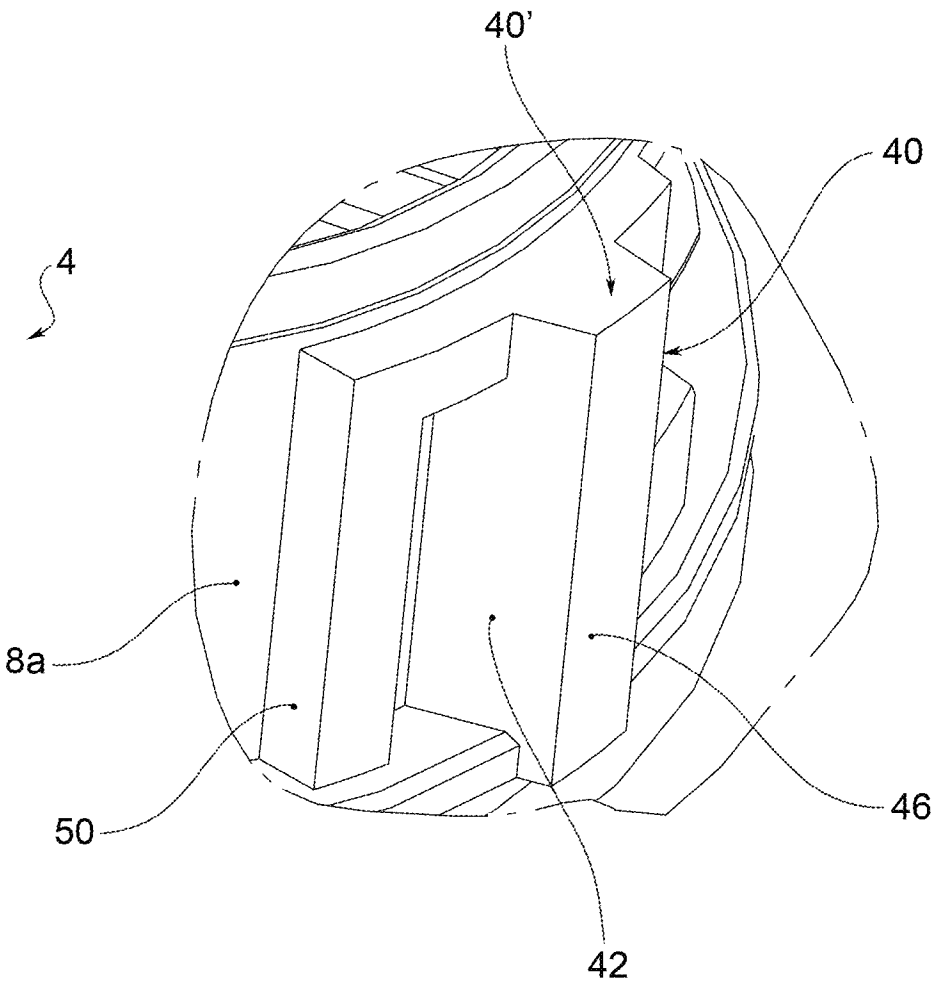
FIG. 5 shows an enlargement of the detail V of FIG. 4.
Figure 4:
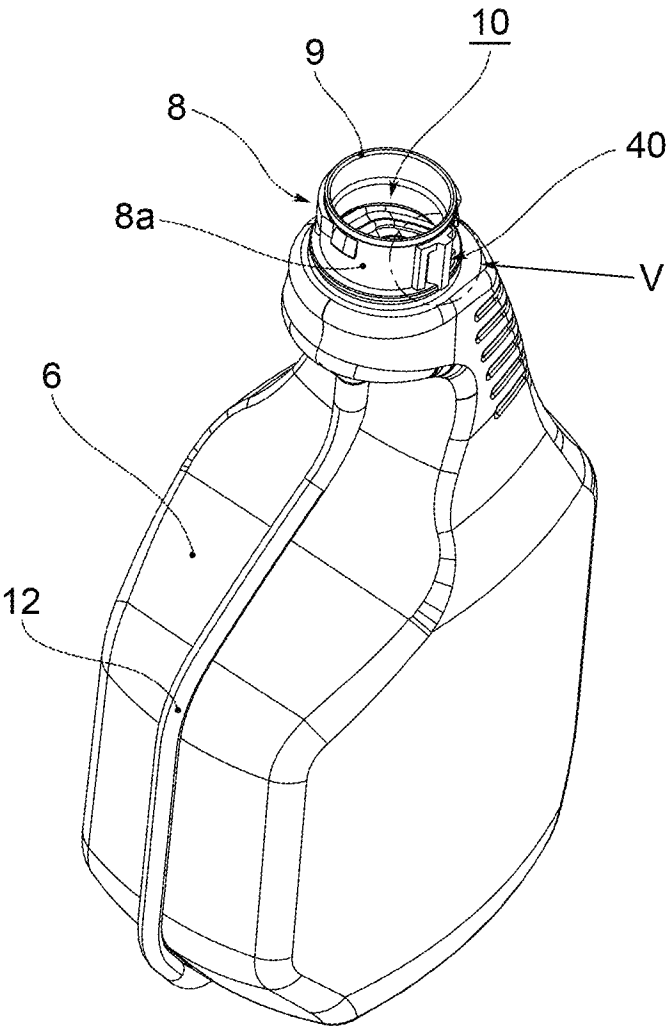
FIG. 4 shows a further view of the bottle.

In said reference region 160 is arranged said rib 40. Preferably, said reference region 160 comprises a reference shoulder 50, spaced circumferentially from the rib 40 or, in one embodiment, joined thereto, on the side opposite to the counterclockwise direction of rotation A (FIG. 5).

Moreover, the reference region 160 comprises a reference guide 162, having extension in the upper band 8', adjacent, in particular joined, to the second coupling shelf 149; the reference guide 162 has an increasing thickness from the free edge 9 towards the annular flange 11 and consists of a guide part 162'.

Axially, below the reference guide 162, the reference region 160 provides for a reference pocket 164 without projections, extending to the rib 40, in the upper band 8' band and in the lower band 8".

Description of an Embodiment of the Skirt

According to the invention, the skirt 32 comprises a seat 60 that opens like an inlet on the inner surface 32*b*; the seat 60, which develops axially from the free edge 38, is configured to accommodate at least partially the rib 40 and to allow the insertion of the frame 30 on the neck 8.

The seat 60 is arranged circumferentially in a predefined angular position, so that the insertion of the frame 30 on the neck only takes place when the frame and the neck are in the correct relative angular position.

Preferably, with reference to the counterclockwise direction of rotation A, the seat 60 has a first side 62 and a second side 64, joined by a limit surface 66.

Preferably, the first side 62 is inclined with respect to the tangential direction, so as to create a ramp outwards in the counterclockwise direction of rotation A; preferably, moreover, the second side 64 is inclined with respect to the tangential direction, so as to create a ramp inwards in the counterclockwise direction of rotation A.

Figure 2:
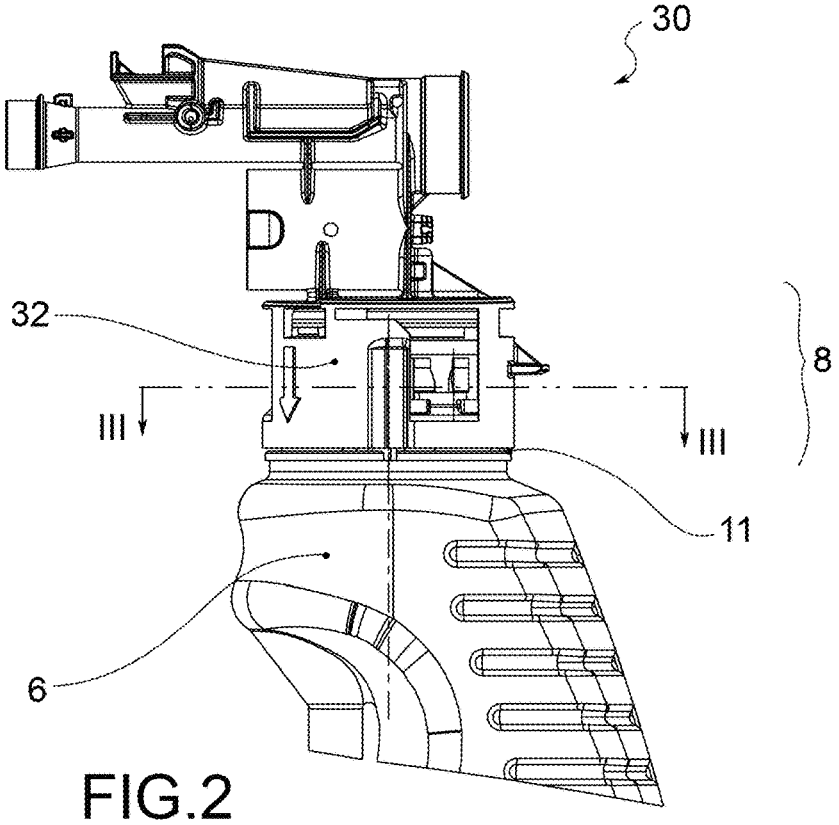
FIG. 2 illustrates the frame and bottle in a assembled configuration.
Figure 3:
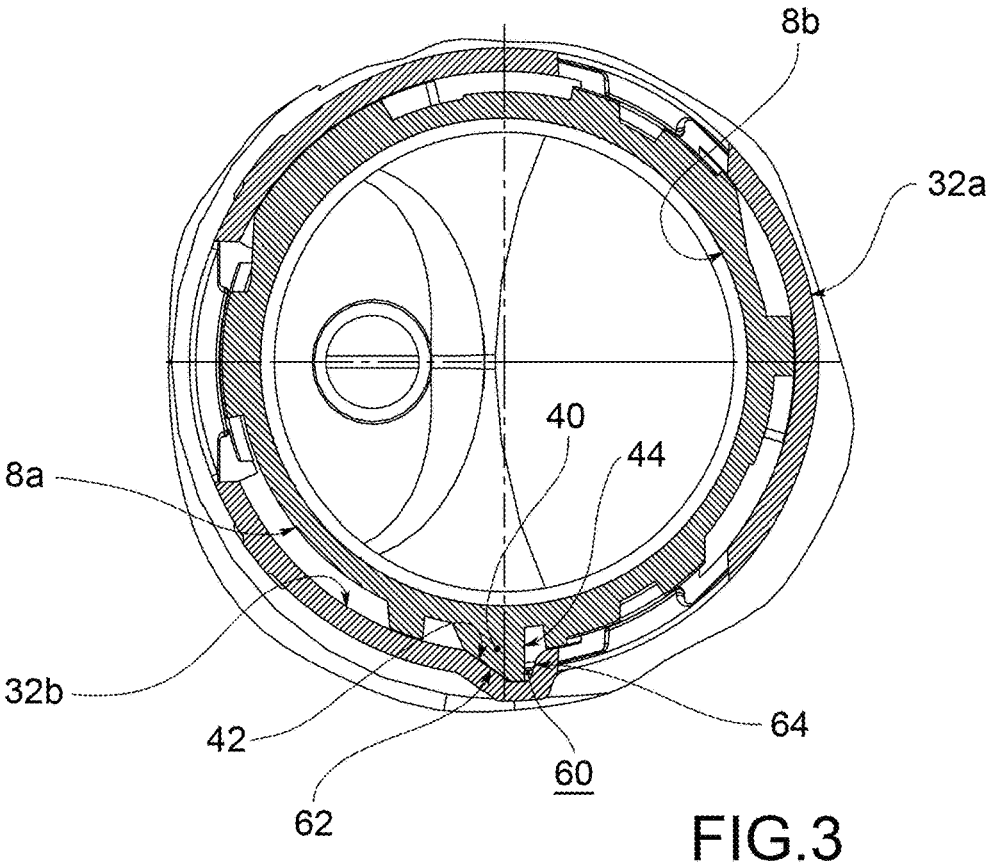
FIG. 3 illustrates a cross-section of the frame and the bottle in FIG. 2, according to the section line III-III in FIG. 2.

Consequently, when the frame 30 and the neck 8 are coupled (FIGS. 2 and 3), the first side 42 of the rib faces the first side 62 of the seat 60, while the second side 44 of the rib 40 faces the second side 64 of the seat 60. Starting from this configuration of the system (assembled configuration), holding the bottle 4 (and thus the neck 8 with the rib 40) and rotating the head 2 (and thus the skirt 32) in the counterclockwise direction of rotation A, one passes into a disassembled configuration of the system. This passage is facilitated by the inclination of the first side 42 of the rib 40 and of the first side 62 of the seat 60, since the seat 60 tends to deform and the rib 40 tends to unseat.

Moreover, for each coupling region 120, 140 of the neck 8, the skirt 32 comprises a coupling window 202, 212 through the thickness of the annular wall, suitable to accommodate the respective coupling guide 122, 142 of the coupling region 120, 140.

Furthermore, for each coupling region 120, 140 of the neck 8, the skirt 32 comprises a flexible coupling tab 204, 214, suitable to deform by sliding over the respective coupling guide 122, 142 and snapping into the respective coupling pocket 124, 144, thus snapping the frame 30 to the neck 8 when arranged in the relative assembled position.

Preferably, said coupling tab 204, 214 is arranged at the lower edge of the respective coupling window 202, 212.

Moreover, for each coupling region 122, 142, the skirt 32 comprises a coupling tooth 206, 216 suitable to penetrate the respective coupling passage 122'", 142'" to guide the application of the frame 30 to the neck 8.

Preferably, said coupling tooth 206, 216 is protruding from the inner surface 32*b* of the skirt 32, arranged axially below the respective coupling tab 204, 214.

Additionally, the skirt 32 has a reference window 220, suitable to accommodate the reference slide 162 of the reference region 160 of the neck 8.

There is further provided, preferably, a flexible reference tab 222, suitable to deform by sliding over the reference guide 162 and to snap into the reference pocket 164, thus snapping the frame 30 to the neck 8, when placed in the relative assembled position.

Preferably, moreover, there are provided two reference teeth 224, 226, protruding from the inner surface 32*b* of the skirt 32 and arranged below the reference tab 222, spaced circumferentially so as to be adjacent to the reference guide 162 to guide the insertion of the skirt 32 on the neck 8.

Description of the Operation of the Connection System

In the relative assembled position, the rib 40 is aligned with the seat 60, so as to be inserted therein; correspondingly, the coupling tabs 204, 214 are aligned with the coupling guides 122, 142 and the reference tab 222 is aligned with the reference guide 162.

When the head 2 is inserted on the neck 8, the rib 40 is accommodated in the seat 60, the coupling tabs 204, 214 are accommodated in the coupling pockets 124, 144 and the reference tab 222 is accommodated in the reference pocket 164.

In order to remove the head 2 from the bottle 4, for example, holding the bottle 4 still, it is necessary to rotate the head 2, for example in the counterclockwise direction of rotation A.

This causes the rib 40 to deform the skirt 32 (generally, elastically) and to unseat 60; at the limit of rotation, the reference shoulder 50 is in abutment with the reference tab 222, or the rib 40 is in abutment with the reference tab 222, or the coupling tab 204, 214 is in abutment with the respective coupling stop 128, 148, thus defining a relative disassembled position.

In said relative disassembled position, the coupling tab 204, 214 is aligned with the respective coupling slide 126, as well as the respective coupling teeth 206, 216, thus allowing the skirt 32 to be removed from the neck 8 smoothly.

In an angular position between the rib 40 and the seat 60 other than the assembled position, the insertion of the skirt of the frame on the neck of the bottle is prevented by said rib, which creates an obstacle that interferes structurally with the annular wall of the skirt.

Also advantageously, outside the relative assembled position, the rib creates an obstacle to the insertion of the skirt on the neck of the bottle, even if the skirt and the neck are offset in an attempt to apply them forcibly, due to the dimensional configuration of the rib.

Further Variant Embodiments

In a variant embodiment of the invention, not shown, the seat is obtained on the outer surface of the neck of the bottle and the rib on the inner surface of the skirt of the frame.

According to a variant embodiment of the invention, not shown, the neck has only one coupling region and, correspondingly, the skirt has only one coupling window with relative coupling tab and coupling tooth.

According to a variant embodiment of the invention, not shown, the neck has three or more coupling regions and, correspondingly, the skirt has three or more coupling windows with relative coupling tab and coupling tooth.

Innovatively, the connection system according to the present invention meets the needs of the sector and overcomes the drawbacks mentioned in reference to the prior art, since the rib constitutes an insurmountable obstacle for the insertion of the skirt of the frame on the neck of the bottle, except by a considerable deformation of the skirt itself, unusual in normal operation.

In other words, the rib constitutes an insurmountable obstacle for the insertion of the skirt of the frame on the neck of the bottle, unless it is aligned with the seat of the skirt, as occurs only in the correct relative assembled position.

It is clear that one skilled in the art, in order to meet contingent needs, may make changes to the connection system described above, all contained within the scope of protection defined by the following claims.

What is claimed is:

1. A connection system between a dispensing head and a bottle of a trigger dispensing device, comprising:

a skirt of a frame of the dispensing head, consisting of a cylindrical annular wall comprising a free edge and an inner surface with an inner diameter (D32*i*), said skirt comprising a seat configured as an inlet on the inner surface, accessible by the free edge;

a neck of the bottle, consisting of a cylindrical annular wall comprising a free edge and an outer surface with an outer diameter (D8*e*), said neck comprising a rib protruding from the outer surface;

wherein, in a relative assembled position, the rib is angularly aligned with the seat and, outside of said relative assembled position, the rib constitutes an impediment to axial insertion of the skirt on the neck.

2. The connection system of claim 1, wherein, in said relative assembled position, the rib is axially insertable into the seat.

3. The connection system of claim 1, wherein the rib has a maximum height (Hmax) relative to the outer surface of the neck greater than half the difference between the inner diameter (D32*i*) of the skirt and the outer diameter (D8*e*) of the neck:

$$Hmax > \tfrac{1}{2}(D32i - D8e).$$

4. The connection system of claim 1, wherein, a direction of rotation (A) being defined, the rib comprises a first side inclined with respect to a tangential direction, so as to form a ramp outwards according to said direction of rotation (A).

5. The connection system of claim 4, wherein the rib comprises a second side, flat and radial.

6. The connection system of claim 5, wherein the rib comprises a limit surface joining the first side and the second side.

7. The connection system of claim 4, wherein the seat comprises a first side inclined with respect to the tangential direction, so as to form a ramp outwards in said direction of rotation (A).

8. The connection system of claim 1, wherein said connection system is a bayonet type connection system.

9. The connection system of claim 1, wherein the skirt is snapped onto the neck.

10. The connection system of claim 9, wherein the outer surface of the neck comprises at least one coupling region comprising a coupling shoulder, a coupling guide angularly aligned with a coupling pocket, a coupling slide angularly aligned with a coupling corridor, and a coupling stop.

11. The connection system of claim 10, wherein the skirt comprises, for the at least one coupling region of the neck, a coupling window, and a flexible coupling tab for snapping the skirt to the neck.

12. The connection system of claim 9, wherein the outer surface of the neck comprises a reference region comprising a reference shoulder.

13. The connection system of claim 9, wherein the outer surface of the neck comprises a reference region comprising a reference guide and a reference pocket angularly aligned to the reference guide.

14. The connection system of claim 13, wherein the skirt comprises a reference window and a flexible reference tab, for snap engagement of the skirt with the neck.

15. A trigger dispensing device comprising:

a bottle comprising a neck;

a dispensing head, comprising a frame applied to the neck of the bottle; and a connection system between the bottle and the dispensing head according to claim 1.

16. The trigger dispensing device of claim 15, wherein:

the bottle consists of a bottle body, closed at a bottom, and said neck, wherein a free edge delimits a circular bottle mouth, having a central axis (Z), and wherein the bottle is fitted with a suction tube made in one piece with the bottle body, open at the bottom of the bottle body and open at a top by an engagement opening arranged inside the bottle, and wherein the engagement opening is offset from the central axis (Z).

17. The trigger dispensing device of claim 16, wherein the engagement opening is placed in the bottle body, below the neck.

18. The trigger dispensing device of claim 16, wherein the dispensing head comprises a main tube configured to engage with the suction tube for sealed insertion into the engagement opening.

19. The trigger dispensing device of claim 18, wherein the main tube is provided with an end section made of a more flexible material than a remaining part of the main tube.

* * * * *